US006022266A

United States Patent [19]

Bullard et al.

[11] Patent Number: 6,022,266

[45] Date of Patent: Feb. 8, 2000

[54] IN-SITU PAD CONDITIONING PROCESS FOR CMP

[75] Inventors: Timothy Scott Bullard, Eden; Richard John Lebel, Williston; Rock Nadeau, Jericho; Paul Henry Smith, Jr., Essex Junction, all of Vt.

[73] Assignee: International Business Machines Corporation, Armonk, N.Y.

[21] Appl. No.: 09/169,382

[22] Filed: Oct. 9, 1998

[51] Int. Cl.[7] ..... B24B 53/00

[52] U.S. Cl. ..... 451/56; 451/444

[58] Field of Search ..... 451/56, 443, 444, 451/41, 288, 287, 72

[56] References Cited

U.S. PATENT DOCUMENTS

| | | | |
|---|---|---|---|
| 5,234,867 | 8/1993 | Schultz et al. . | |
| 5,377,451 | 1/1995 | Leoni et al. . | |
| 5,407,526 | 4/1995 | Danielson et al. . | |
| 5,486,129 | 1/1996 | Sandhu et al. . | |
| 5,605,499 | 2/1997 | Sugiyama et al. | 451/443 |
| 5,647,789 | 7/1997 | Kitta et al. | 451/288 |
| 5,785,585 | 7/1998 | Manfredi et al. | 451/56 |

FOREIGN PATENT DOCUMENTS

| | | | |
|---|---|---|---|
| 4035871 | 2/1992 | Japan | 451/526 |

*Primary Examiner*—Robert A. Rose

*Attorney, Agent, or Firm*—DeLio & Peterson LLC; Shirley S. MA; Howard J. Walter, Jr.

[57] ABSTRACT

An improved method of in-situ conditioning of a polishing pad for use with a stationary pad conditioner during chemical mechanical polishing is described. A polishing table having a polishing pad on its surface is rotated in a first direction during polishing of a semiconductor wafer. A polishing pad conditioner is adjustably attached to the rotating polishing table such that the conditioner is stationary in relation to the rotating polishing table. The conditioner has a roughened surface which is in contact with the polishing pad providing in-situ conditioning during polishing of a semiconductor wafer. After polishing of the semiconductor wafer, the polishing table is rotated in a second direction while the conditioner is still in contact with polishing pad. Rotating the polishing pad in a second direction dislodges the polishing debris clogging the roughened surface of the conditioner and redistributes CMP slurry. The roughened surface of the pad conditioner is refreshed allowing more effective conditioning of the polishing pad. Pad life is prolonged, polishing is stabilized, and the polish cycle time is reduced.

21 Claims, 2 Drawing Sheets

IN-SITU PAD CONDITIONING PROCESS FOR CMP

BACKGROUND OF THE INVENTION

1. Field of the Invention

This invention relates to the manufacture of semiconductor devices, and in particular to a method of conditioning a polishing pad used in chemical mechanical polishing (CMP).

2. Description of Related Art

Fabrication of semiconductor integrated circuits (IC) is a complicated multi-step process creating microscopic structures with various electrical properties to form a connected set of devices. As the level of integration of IC's increases, the devices become smaller and more densely packed, requiring more levels of photolithography and more processing steps. As more layers are built up on the silicon wafer, problems caused by surface non-planarity become increasingly severe and can impact yield and chip performance. During the fabrication process, it may become necessary to remove excess material in a process referred to as planarization.

A common technique used to planarize the surface of a silicon wafer is CMP. CMP involves the use of a polishing pad affixed to a circular polishing table and a holder to hold the wafer face down against the rotating pad. A slurry containing abrasive and chemical additives are dispensed onto the polishing pad. The pad itself is typically chosen for its ability to act as a carrier of the slurry and to wipe away the grit and debris resulting from the polishing action.

The wafer and the polishing pad rotate relative to each other. The rotating action along with the abrasive and chemical additives of the slurry results in a polishing action that removes material from the surface of the wafer. Protrusions on the surface erode more efficiently than recessed areas leading to a flattening or planarization of the wafer surface.

A key factor in maintaining the performance and longevity of the CMP apparatus is conditioning the polishing pad. Typically the polishing pad is comprised of blown polyurethane with a felt surface layer containing many small pores to facilitate the flow of slurry to beneath the wafer being polished. There are fibers of the polyurethane which are substantially perpendicular to the surface of the polishing pad. An example of such a polishing pad is the model IC-1000 manufactured by the Rodel Corporation, 945 East San Salvador Drive, Scottsdale, Ariz. 85258.

As the number of wafers polished increases, the polishing pad becomes filled with debris formed by the accumulation of chemical reaction products and abrasives from the slurry. This causes the polishing pad to become matted down or to wear unevenly, also known as the "glazing effect". Thus, it becomes necessary to restore the polishing pad to a state suitable for continued wafer polishing.

A type of pad conditioner known in the art is a stationary conditioner mounted to the polishing pad. The roughening surface of the conditioner, also known as a grit, is in contact with the polishing pad surface. An example of such a grit is a diamond planar grinding disc, 70 $\mu$m diamond, manufactured by Buehler, Microstructure Analysis Division, 41 Waukegan Road, Lake Bluff, Ill. 60044, Part No. 46-4316.

An example of a pad conditioner can be found in U.S. Pat. No. 5,785,585 issued on Jul. 28, 1998, and assigned to the assignee of the present invention. Common problems associated with such stationary pad conditioners are the buildup of slurry along one edge of the conditioner, and the buildup of debris in the grit. This causes an accelerated decline in polishing rates and uniformity.

A prior art solution to overcome the problem of debris buildup in the stationary conditioner grit is to stop the polisher and manually scrub the pad debris from the grit after every 4 to 5 wafers. This increases the polishing cycle time for polishers using this type of pad conditioner.

Bearing in mind the problems and deficiencies of the prior art, it is therefore an object of the present invention to provide a method of refreshing the pad conditioner in-situ to enhance pad conditioning.

It is another object of the present invention to provide a method of polishing a semiconductor wafer.

A further object of the invention is to provide an improved in-situ pad conditioning process for CMP.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a method of in-situ conditioning a polishing pad comprising the steps of: (a) providing a polishing apparatus having a rotating polishing pad rotating in a first direction; (b) contacting the polishing pad with a pad conditioner having a roughened surface, the conditioner stationarily mounted in relation to the rotating polishing pad such that the roughened surface is in contact with the polishing pad; (c) providing an object in need of polishing; (d) contacting the polishing pad with the object to commence polishing; (e) removing the object from contact with the polishing pad; and (f) rotating the polishing pad in a second direction while still in contact with the roughened surface of the pad conditioner to remove polishing debris.

Preferably, the roughened surface of the conditioner comprises a diamond media and wherein the step of contacting the polishing pad with a pad conditioner comprises contacting the polishing pad with the diamond media.

The step of rotating the polishing pad in a second direction refreshes the conditioner enhancing the polishing effect of the polishing pad. Preferably, the step of rotating the polishing pad in a second direction occurs for about 10 to about 40 seconds.

The method of the present aspect may further include the step of providing a further object in need of polishing and repeating the steps of contacting the polishing pad with a pad conditioner having a roughened surface, the conditioner stationarily mounted in relation to the rotating polishing pad such that the roughened surface is in contact with the polishing pad; providing an object in need of polishing; contacting the polishing pad with the object to commence polishing; removing the object from contact with the polishing pad; and rotating the polishing pad in a second direction while still in contact with the roughened surface of the pad conditioner to remove polishing debris.

The polishing pad comprises a felt pad of blown polyurethane having a plurality of fibers extending substantially perpendicular and wherein the step of contacting the polishing pad with the pad conditioner comprises contacting the fibers of the polishing pad with the roughened surface of the pad conditioner.

In another aspect, the present invention relates to a method of conditioning a polishing pad while polishing a semiconductor wafer comprising the steps of: (a) providing a rotating platen rotating in a first direction having a polishing pad comprising a felt pad of blown polyurethane having a plurality of fibers extending substantially perpendicular, situated on the surface of the rotating platen; (b) providing a holder for placing and polishing a semiconductor wafer in need of polishing onto the polishing pad; (c) providing a conditioner having a grit containing surface which brushes the plurality of fibers of the polishing pad during polishing of the semiconductor wafer; (d) contacting the conditioner to the polishing pad such that the grit containing surface is in contact with the polishing pad; (e) commencing polishing by contacting a semiconductor wafer in need of polishing with the polishing pad; (f) discontinuing polishing and removing the semiconductor wafer; and (g) rotating the platen in a second direction for about 10 to 40 seconds such that the grit containing surface of the conditioner brushes the plurality of fibers of the polishing pad in a second direction dislodging debris formed on the grit containing surface, wherein the grit containing surface is cleared of debris enhancing conditioner performance.

Preferably, the grit comprises a diamond media and wherein step (d) comprises contacting the conditioner to a polishing pad such that the diamond media is on contact with the polishing pad.

Rotating the platen in a second direction refreshens the conditioner enhancing conditioning of the polishing pad.

The method may further include the step of providing a further semiconductor wafer in need of polishing and repeating steps (e) through (g).

In still yet another aspect, the present invention relates to a method of polishing a semiconductor wafer comprising the steps of: (a) providing a polishing machine having a rotatable polishing pad; (b) providing a pad conditioner having a roughened surface; (c) providing a semiconductor wafer in need of polishing; (d) contacting the polishing pad with the pad conditioner such that the pad conditioner is stationary in relation to the polishing pad and the roughened surface of the pad conditioner is disposed on the polishing pad; (e) rotating the polishing pad in a first direction; (f) contacting the wafer with the polishing pad; (g) polishing the wafer to produce a planarized wafer while the pad conditioner is conditioning the polishing pad; (h) discontinuing polishing of the wafer; (i) removing the planarized wafer; and (j) rotating the polishing pad in a second direction while said pad conditioner is still in contact with the polishing pad to rejuvenate the pad conditioner by removing any debris accumulated on the roughening surface of the pad conditioner.

Preferably, the step of rotating the polishing pad in a second direction occurs for up to 45 seconds, and most preferably, for about 10 to about 40 seconds.

The roughened surface of the pad conditioner comprises a diamond media and wherein step (d) comprises contacting the polishing pad with the pad conditioner such that the diamond media is disposed on the polishing pad.

The step of rotating the polishing pad in a second direction may also occur during removal of the polished wafer. The method may further include the step of providing a further semiconductor wafer in need of polishing and repeating steps (f) through (j).

In yet another aspect, the present invention relates to a method of conditioning a polishing pad, of the type wherein a pad conditioner having a roughened surface sits stationary on the polishing pad during rotation of the polishing pad in a first direction, the improvement comprising rotating the polishing pad in a second direction such that any debris accumulated on the roughened surface of the pad conditioner is removed.

The roughened surface of the pad conditioner comprises a diamond media which is in contact with the polishing pad during rotation of the polishing pad in a first and second direction. Preferably, the rotation of the polishing pad in a second direction occurs for up to about 45 seconds, most preferably, for about 10 to about 40 seconds.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
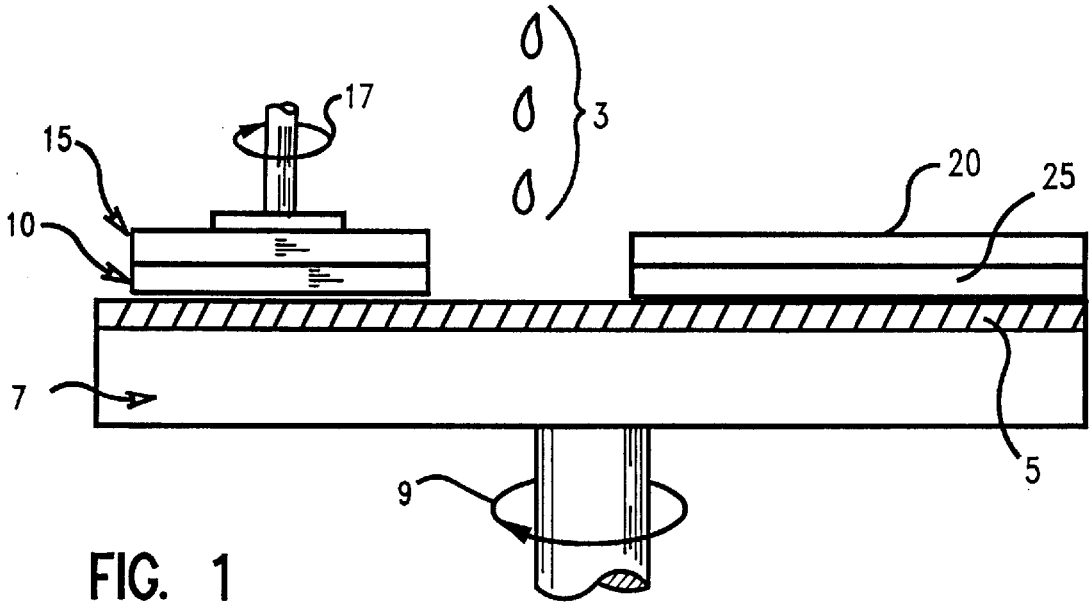
FIG. 1 is an elevational side view of a CMP tool used in the method of the present invention.

In describing the preferred embodiment of the present invention, reference will be made herein to FIGS. 1–3 of the drawings in which like numerals refer to like features of the invention. Features of the invention are not necessarily shown to scale in the drawings.

Figure 2:
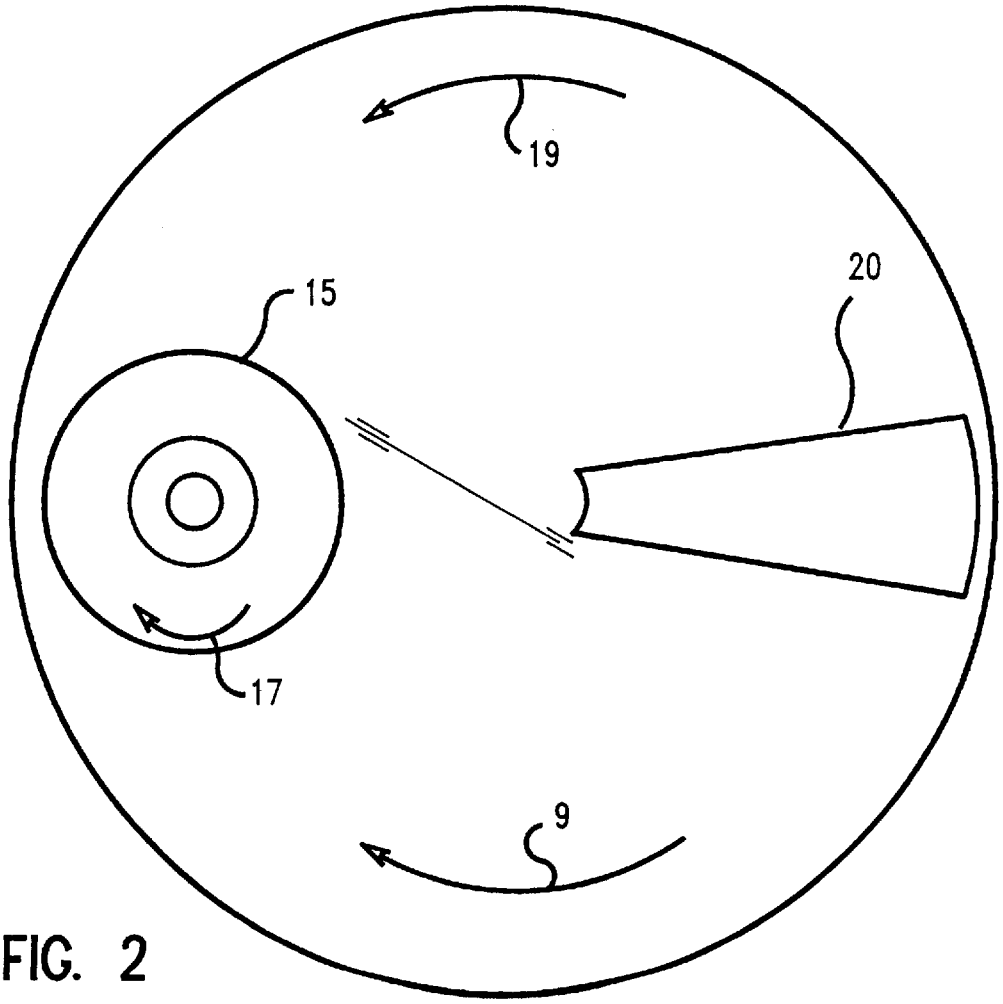
FIG. 2 is an elevational top view of a CMP tool used in the method of the present invention.

FIG. 1 is an elevational side view of a CMP apparatus which can utilize a method of the present invention. Generally, the CMP apparatus comprises a polishing pad 5 situated on a polishing table or platen 7. Polishing table 7 is linked to a motor which rotates polishing table 7 in a first direction 9 at a rate of about 1 to 100 rpm. An example of a CMP apparatus of this type is the model IC-1000 manufactured by the Rodel Corporation, 945 East San Salvador Drive, Scottsdale, Ariz. 85258.

A wafer holder 15 is employed to hold semiconductor wafer 10 face down against polishing pad 5. The wafer 10 is held in place by applying a vacuum to the back side of wafer 10 or by wet surface tension. A retaining ring (not shown) may be employed to keep wafer 10 from slipping out from beneath the wafer holder 15 during polishing. The wafer holder 15 also rotates, usually in the same direction as polishing table 7, at a rate of about 1 to 100 rpm. A downward force is also applied in the downward vertical direction against wafer 10 and presses it against polishing pad 5 as it is being polished.

As the polishing table 7 and wafer holder 15 rotate, a water based slurry containing an abrasive, such as silica, and a chemical additive, such as a strong base, is dispensed onto polishing table 7 as shown with reference numeral 3. The chemical additive serves to etch the wafer surface and to facilitate the mechanical removal of the wafer material by abrasion.

This polishing process is capable of removing thousands of angstroms of material from the wafer surface every minute, with protrusions eroding faster than recessed areas. The polishing process is carried out until the wafer surface is ground to a highly planar state. During the polishing process, both the wafer surface and the polishing pad are abraded. After numerous wafers are polished, the pad becomes worn diminishing the efficiency of the polishing pad and the rate of material removal. It is at this point that a polishing pad is treated or "conditioned" so that a high rate of uniform polishing can once again be obtained.

The conditioner 20 of FIG. 1 is a stationary pad conditioner such as the wedge conditioner disclosed in U.S. Pat. No. 5,785,585. The conditioner 20 sits in a frame which is adjustably attached to a stationary fixture holding the frame stationary relative to the rotating polishing table. The conditioner may be used with or without slurry.

Attached to the bottom surface of conditioner 20 is a grit 25 such as a Buehler 70 $\mu$m diamond disc used to roughen the surface of the polishing pad to condition the pad. The grit 25 is in constant contact with polishing pad 5 to provide in-situ conditioning of polishing pad 5. FIG. 2 shows more accurately the radial positioning of conditioner 20 and the position of wafer holder 15. Generally, the length of conditioner 20 is of a sufficient length to cover the polishing path. Thus, as the polishing table is rotating in a first direction 9, the grit 25 of conditioner 20 conditions polishing pad 5 by lifting the fibers of the polyurethane pad.

It has been unexpectedly found in the large scale manufacture of semiconductor wafers using stationary pad conditioners that there is a build-up of slurry along at least one edge of the stationary conditioners known in the art, in particular the wedge conditioner, and a build-up of debris which clogs the conditioner grit. The slurry build-up prevents even distribution of slurry prolonging the polishing cycle. The build-up of debris clogs the conditioner grit preventing the conditioner from effectively conditioning the polishing pad. This results in a large consumable cost in that the polishing pad effectively polishes only about 25 to 50 wafers per pad.

Figure 3:
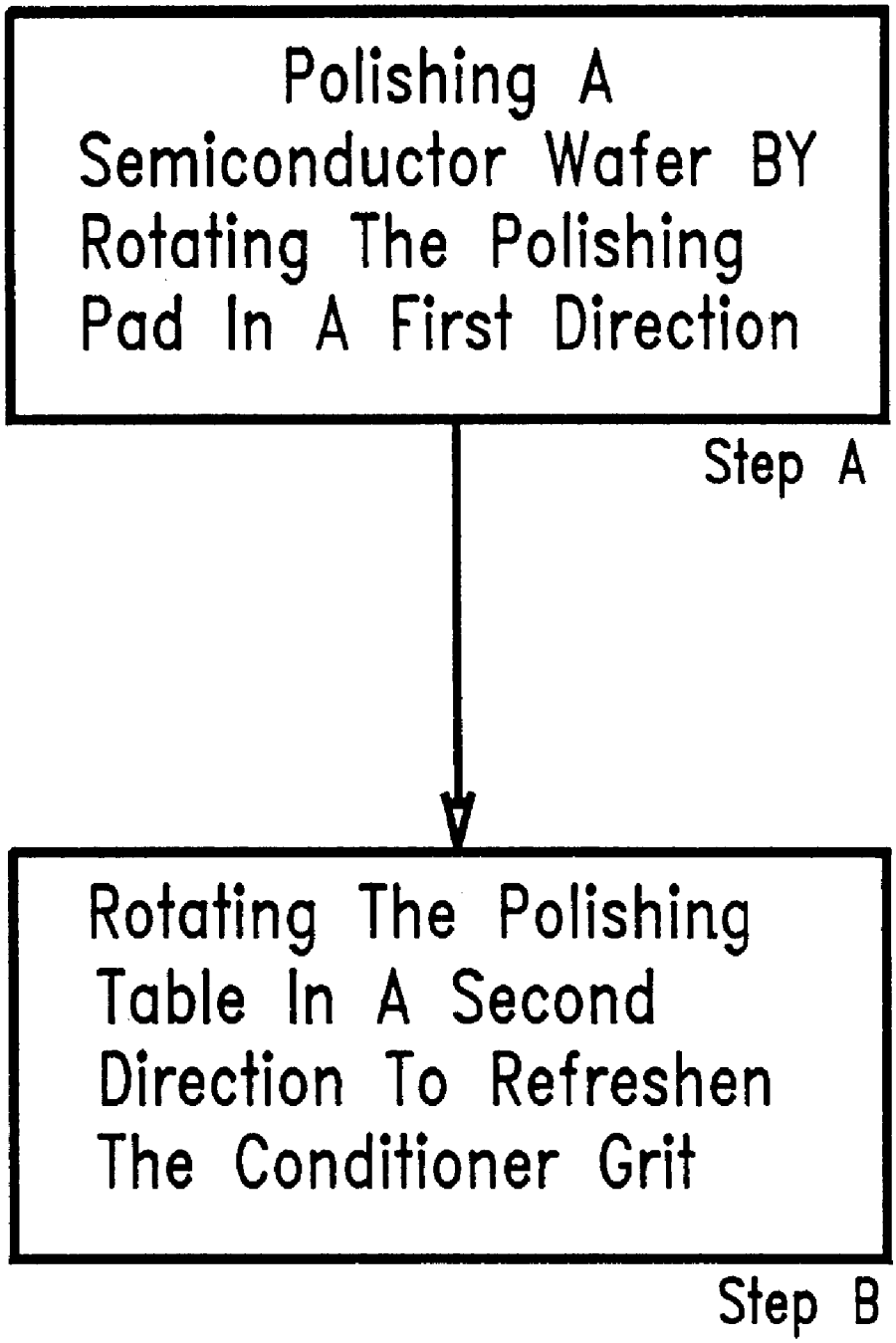
FIG. 3 is a flowchart of the steps of a preferred embodiment of the method of the present invention.

FIG. 3 shows the steps in the method of the present invention to avoid the build-up of slurry along one edge of conditioner 20 and to remove the debris clogging grit 25. Step A is the step of polishing a semiconductor wafer by rotating the polishing table in a first direction. Step B occurs during the wafer unloading stage when the polishing table is rotated in a second direction, preferably, for up to about 45 seconds, most preferably, for about 10 to about 40 seconds in order to "clean" the grit.

Rotating the polishing table in the second direction dislodges the debris caught in the crevices of the grit and redistributes the slurry. When the conditioner is "cleaned" the polish rate is stabilized and operators can polish several wafer lots in succession, on the order of about 200 to 250 wafers per pad. The more efficient conditioning of the polishing pad prolongs its useful life and shortens the polishing cycle increasing the number of wafers polished.

The above invention achieves the objects recited above. It has been found that the slurry and debris build-up in the conditioner grit after the polishing of semiconductor wafers are prevented by rotating the polishing table in a second direction. The conditioner is refreshed since the counter rotation of the polishing table loosens the debris in the grit and redistributes the slurry on the polishing pad. Polishing of semiconductor wafers using the method of the present invention has prolonged the useful life of each polishing pad allowing shorter polish cycle time and increasing the number of wafers polished per pad. The improved in-situ pad conditioning method provides a more stable polish rate than using a stationary pad conditioner alone.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of in-situ conditioning a polishing pad comprising the steps of:

(a) providing a polishing apparatus having a rotating polishing pad rotating in a first direction;

(b) contacting said polishing pad with a pad conditioner having a roughened surface, said conditioner stationarily mounted in relation to said rotating polishing pad such that the roughened surface is in contact with said polishing pad;

(c) providing an object in need of polishing;

(d) contacting said polishing pad with said object to commence polishing;

(e) removing said object from contact with said polishing pad; and (f) rotating said polishing pad in a second direction while still in contact with the roughened surface of said pad conditioner to remove polishing debris.

2. The method according to claim 1, wherein the roughened surface of said conditioner comprises a diamond media and wherein step (b) comprises contacting said polishing pad with said diamond media.

3. The method according to claim 1, wherein said step of rotating said polishing pad in a second direction refreshes said conditioner enhancing the polishing effect of said polishing pad.

4. The method according to claim 1, wherein said step of rotating said polishing pad in a second direction occurs for about 10 to about 40 seconds.

5. The method according to claim 1, further including the step of providing a further object in need of polishing and repeating steps (d) through (f).

6. The method according to claim 1, wherein said polishing pad comprises a felt pad of blown polyurethane having a plurality of fibers extending substantially perpendicular and wherein step (b) comprises contacting the fibers of said polishing pad with the roughened surface of said pad conditioner.

7. A method of conditioning a polishing pad while polishing a semiconductor wafer comprising the steps of:

(a) providing a rotating platen rotating in a first direction having a polishing pad comprising a felt pad of blown polyurethane having a plurality of fibers extending substantially perpendicular, situated on the surface of said rotating platen;

(b) providing a holder for placing and polishing a semiconductor wafer in need of polishing onto the polishing pad;

(c) providing a conditioner having a grit containing surface which brushes the plurality of fibers of said polishing pad during polishing of said semiconductor wafer;

(d) contacting said conditioner to said polishing pad such that the grit containing surface is in contact with said polishing pad;

(e) commencing polishing by contacting a semiconductor wafer in need of polishing with said polishing pad;

(f) discontinuing polishing and removing said semiconductor wafer; and (g) rotating said platen in a second direction for about 10 to 40 seconds such that the grit containing surface of said conditioner brushes the plurality of fibers of said polishing pad in a second direction dislodging debris formed on the grit containing surface, wherein said grit containing surface is cleared of debris enhancing conditioner performance.

8. The method according to claim 7, wherein the grit of said conditioner comprises a diamond media and wherein step (d) comprises contacting said conditioner to said polishing pad such that said diamond media is in contact with said polishing pad.

9. The method according to claim 7, wherein said step of rotating said platen in a second direction refreshens said conditioner enhancing conditioning of said polishing pad.

10. The method according to claim 7, further including the step of providing a further semiconductor wafer in need of polishing and repeating steps (e) through (g).

11. A method of polishing a semiconductor wafer comprising the steps of:

(a) providing a polishing machine having a rotatable polishing pad;

(b) providing a pad conditioner having a roughened surface;

(c) providing a semiconductor wafer in need of polishing;

(d) contacting said polishing pad with said pad conditioner such that said pad conditioner is stationary in relation to said polishing pad and the roughened surface of said pad conditioner is disposed on said polishing pad;

(e) rotating the polishing pad in a first direction;

(f) contacting said wafer with said polishing pad;

(g) polishing said wafer to produce a planarized wafer while said pad conditioner is conditioning said polishing pad;

(h) discontinuing polishing of said wafer;

(i) removing said planarized wafer; and (j) rotating the polishing pad in a second direction while said pad conditioner is still in contact with said polishing pad to rejuvenate said pad conditioner by removing any debris accumulated on the roughening surface of said pad conditioner.

12. The method according to claim 11, wherein said step of rotating the polishing pad in a second direction occurs for up to about 45 seconds.

13. The method according to claim 11, wherein said step of rotating the polishing pad in a second direction occurs for about 10 to about 40 seconds.

14. The method according to claim 11, wherein the roughened surface of said pad conditioner comprises a diamond media and wherein step (d) comprises contacting said polishing pad with said pad conditioner such that said diamond media is disposed on said polishing pad.

15. The method according to claim 11, wherein said step of rotating the polishing pad in a second direction occurs during removal of said polished wafer.

16. The method according to claim 11, further including the step of providing a further semiconductor wafer in need of polishing and repeating steps (f) through (j).

17. In a method of conditioning a polishing pad, of the type wherein a pad conditioner having a roughening surface sits stationary on the polishing pad during rotation of the polishing pad in a first direction, the improvement comprising:

rotating said polishing pad in a second direction such that any debris accumulated on the roughening surface of said pad conditioner is removed.

18. The method according to claim 17, wherein the roughened surface of said pad conditioner comprises a diamond media which is in contact with said polishing pad during rotation of said polishing pad in a first and second direction.

19. The method according to claim 17, wherein the rotation of said polishing pad in a second direction occurs for up to about 45 seconds.

20. The method according to claim 17, wherein the rotation of said polishing pad in a second direction occurs for about 10 to about 40 seconds.

21. A method of polishing a semiconductor wafer comprising the steps of:

(a) providing a polishing machine having a rotatable polishing pad and a pad conditioner disposed on and in contact with the polishing pad;

(b) contacting a semiconductor wafer to said polishing pad;

(c) rotating said polishing pad in a first direction for a portion of time used to polish said semiconductor wafer while said pad conditioner remains in contact with said polishing pad;

(d) rotating said polishing pad in a second direction such that any debris accumulated on the pad conditioner is removed and the polishing pad is refreshed; and (e) continuing polishing as needed.

* * * * *

UNITED STATES PATENT AND TRADEMARK OFFICE

CERTIFICATE OF CORRECTION

PATENT NO. : 6,022,266

DATED : Feb. 8, 2000

INVENTOR(S) : Bullard et al.

It is certified that error appears in the above-identified patent and that said Letters Patent is hereby corrected as shown below:

Title page, column 2, Attorney, Agent or Firm, line , delete "MA" and substitute therefore - - Ma- -

Col. 1, line 28, delete "are" and substitute therefor- - is- -

Col. 1, line 67, delete "buildup" and substitute therefor - - build-up- -

Col. 2, line 1, delete "buildup" and substitute therefor - - build-up- -

Col. 2, line 5, delete "buildup" and substitute therefor- - build-up- -

Col. 3, line 24, delete "on" and substitute therefor - - in- -

Signed and Sealed this

Twentieth Day of February, 2001

*Attest:*

Nicholas P. Godici

NICHOLAS P. GODICI

*Attesting Officer*

*Acting Director of the United States Patent and Trademark Office*